US005946340A

United States Patent [19]

Ramthun et al.

[11] Patent Number: 5,946,340

[45] Date of Patent: Aug. 31, 1999

[54] PROCESS FOR MELTING OF METAL MATERIALS IN A SHAFT FURNACE

[75] Inventors: Josef Ramthun, Hilzingen; Albert Koperek, D-Essen, both of Germany

[73] Assignee: Georg Fischer Disa Engineering AG, Schaffhausen, Switzerland

[21] Appl. No.: 08/952,316

[22] PCT Filed: Mar. 3, 1997

[86] PCT No.: PCT/CH97/00080

§ 371 Date: Feb. 6, 1998

§ 102(e) Date: Feb. 6, 1998

[87] PCT Pub. No.: WO97/33134

PCT Pub. Date: Sep. 12, 1997

[30] Foreign Application Priority Data

Mar. 3, 1996 [CH] Switzerland ..... 0556

[51] Int. Cl.[6] ..... F27D 13/00

[52] U.S. Cl. ..... 373/80; 373/1; 373/85

[58] Field of Search ..... 373/77–82, 88, 373/85, 18, 22, 26–123; 432/12; 75/10.42; 266/162, 175

[56] References Cited

U.S. PATENT DOCUMENTS

| | | | |
|---|---|---|---|
| 3,964,897 | 6/1976 | Langhammer | 373/88 |
| 4,547,150 | 10/1985 | Vereecke | 432/12 |
| 4,851,039 | 7/1989 | Papst et al. | 75/10.15 |
| 5,060,913 | 10/1991 | Reid | 266/162 |
| 5,513,206 | 4/1996 | Mori et al. | 373/80 |

*Primary Examiner*—Tu Ba Hoang
*Attorney, Agent, or Firm*—Bachman & Lapointe, P.C.

[57] ABSTRACT

A process for smelting metallic raw materials in a shaft furnace having beds of metallic raw material and coke comprises injecting concurrently into the shaft furnace (1) a mixture of flue gases and oxygen at a subsonic velocity and (2) preheated oxygen at supersonic velocity wherein the supersonic velocity oxygen is injected into the coke bed.

6 Claims, 4 Drawing Sheets

PROCESS FOR MELTING OF METAL MATERIALS IN A SHAFT FURNACE

BACKGROUND OF THE INVENTION

The invention relates to a process for smelting metallic raw materials in a shaft furnace, in which coke is burnt with preheated air and largely pure oxygen and the flue gases heat the metallic charge in countercurrent, and in which the melt is superheated and carburized in the coke bed.

Metallic and non-metallic materials, such as iron and non-ferrous metals, basalt and greenstone, are still smelted in coke-heated shaft furnaces in spite of the development of electrical and flame-heated smelting processes. Thus, about 60% of all iron materials are nowadays still produced in cupola furnaces.

The reason for this high market share of the cupola furnace is the continuous further development, with the development of the hot-blast cupola furnace and the use of oxygen amongst the large number of known process modifications being of importance.

Thus, for example, the process engineering disadvantages and metallurgical disadvantages of the cold-blast cupola furnace, such as low iron temperatures high burn-off of silicon low carburization high coke consumption high sulfur absorption high wear of refractories have largely been compensated by the development of the hot-blast cupola furnace.

Similar improvements are achieved by the use of oxygen, the oxygen being blown into the cupola furnace either by enriching the cupola furnace blast up to a maximum of 25% or by direct injection at subsonic velocity. Owing to the high operating costs, however, oxygen is employed only discontinuously, for example for rapid starting of the cold furnace or for raising the iron temperature for a limited period. The possibility of increasing the output, i.e. continuous use of oxygen, is exploited only in exceptional cases.

In spite of the introduction of these process modifications, it is still possible for the smelting output the iron temperature the coke charge to be varied only within a very narrow range at the optimum operating point.

The relationship between melting output and blast rate as well as the rate of addition of oxygen is described by the known Jungbluth equation. This equation results from a generation of mass and energy, with the coke charge and the combustion ratio having to be determined empirically for every cupola furnace.

Linking the active parameters, namely blast rate, coke charge and combustion ratio, to the target parameters results in the smelting output diagram, FIG. 1, with curves of equal coke charge and equal blast rate.

This smelting output diagram, known as the Jungbluth diagram,must be determined empirically for every cupola furnace. A transfer to other cupola furnaces is not possible, since the operating behavior changes immediately when the conditions such as lumpiness of the coke, reactivity of the coke, charge composition, blast velocity, furnace pressure, temperature etc. are altered.

The heat losses are lowest at the temperature maximum. At unduly high blast rates, i.e. high flow velocity, the furnace is overblown. At unduly small air rates, i.e. unduly low flow velocity, the furnace is underblown. In both cases, the combustion temperature is lowered, since, on the one hand, the additional $N_2$ ballast must also be heated and, on the other hand, heat is removed by the additional formation of CO. Furthermore, the elements accompanying the iron are more thoroughly oxidized in overblowing.

By using oxygen up to, for example, 24% by volume in the blast, the net line is shifted towards the top right, i.e. to higher temperatures and to higher iron throughputs. The temperature maximum flattens, and the furnace becomes insensitive to underblowing or overblowing.

A reduction in the coke charge at constant iron throughputs and reduced blast rate is not possible even with continuous addition of oxygen, since the iron temperature then falls and additional metallurgical and process engineering problems, such as lower carburization increase in the Si burn-off increase in the FeO content in the slag wall channeling in the furnace due to a reduction in the blast velocity arise. The cupola furnace produces an iron which cannot be cast.

Since, from the point of view of combustion technology, a large excess of coke is present, a reduction in the quantity of coke at constant smelting output is of great interest for reason of economics, since the manufacturing costs of molten iron are affected essentially by the remelting costs and the raw material costs.

Furthermore, it has been known for a long time that, especially in the case of cupola furnaces having large frame diameters, the so-called "dead man" remains standing in the center of the furnace in spite of oxygen enrichment of the blast and/or direct oxygen injection at subsonic velocity. The reaction between the oxygen blown in and the carbon takes place only within a restricted region in the vicinity of the blast nozzle, i.e. the furnace operates with wall channeling.

The coke present in the center of the furnace does not contribute to the reaction, since, due to the low momentum, the combustion air cannot penetrate the bed located in front. The reaction zone is located in the immediate vicinity of the blast nozzle (FIG. 2*a*). The depth of penetration is not substantially increased by the known enriching of the furnace blast with oxygen or by blowing the oxygen in at subsonic velocity. Due to the higher availability of oxygen, the reaction zone is widened upwards owing to the pressure conditions (FIG. 2*b*).

As a precondition for the desired reduction in the quantity of combustion coke, uniform combustion across the furnace cross-section, i.e. uniform distribution of the available oxygen, must be the objective. For this purpose, the momentum, i.e. the velocity of the air or of the oxygen jets, must be increased beyond the target values to be described as state of the art hitherto.

The patent application GB 2,018 295 describes a system by means of which the oxygen is blown in by means of Laval nozzles incorporated centrally into the blast nozzles, i.e. at supersonic velocity, in order to minimize the wear or the refractory lining. It was not possible to reduce the coke charge.

DETAILED DESCRIPTION

Figure 1:
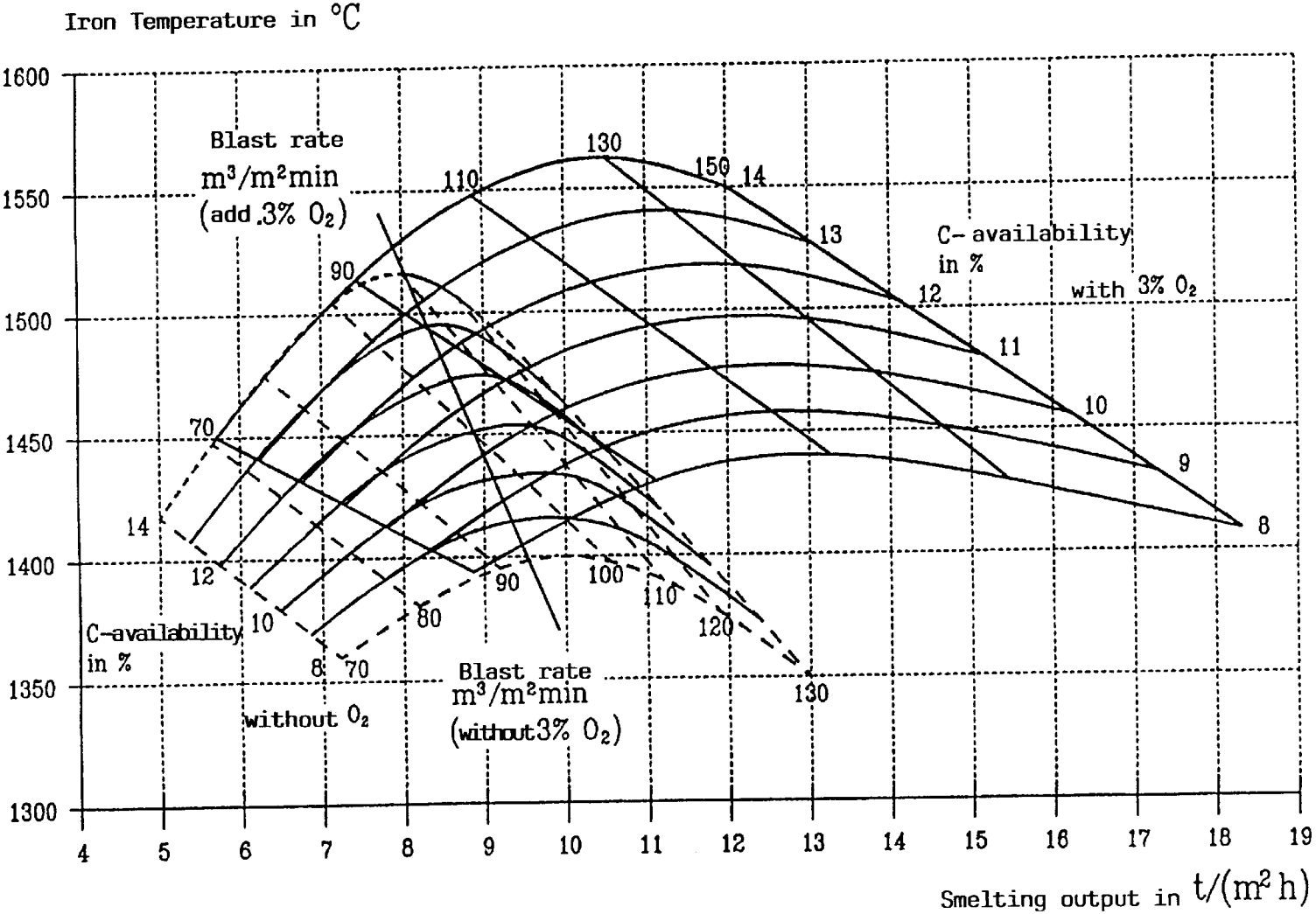
FIG. 1 is a smelting output diagram in accordance with the prior art.
Figure 2A:
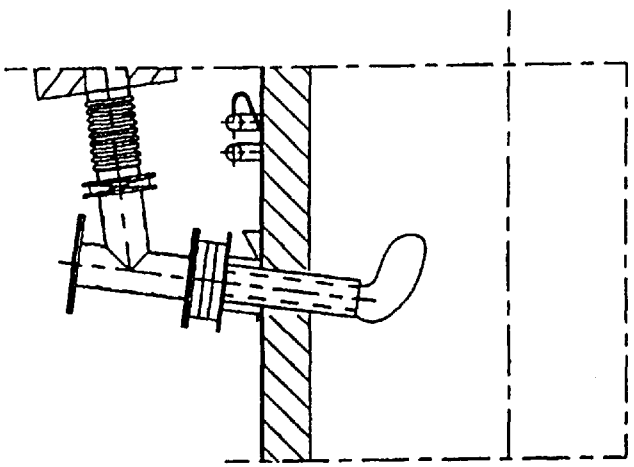
FIGS. 2*a* and 2*b* illustrate the depth of oxygen penetration in a blast furnace as a function of blowing oxygen at a subsonic velocity.
Figure 2B:
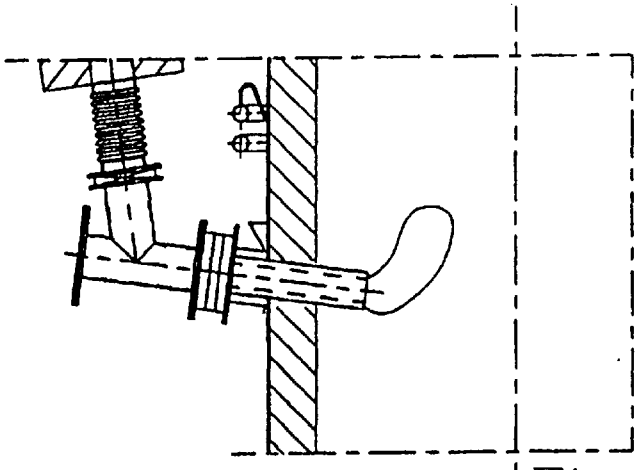
Figure 2C:
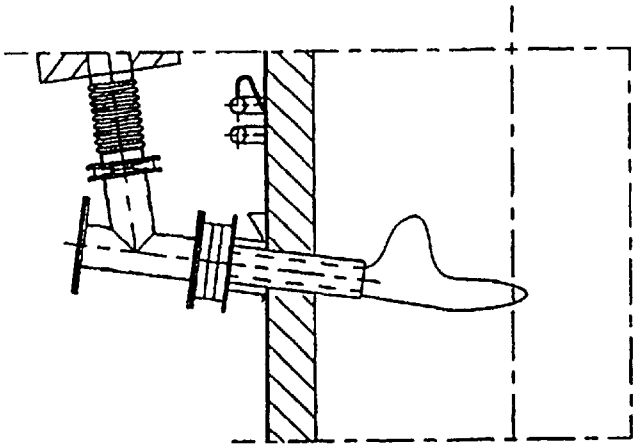
FIGS. 2*c* and 2*d* illustrate the depth of oxygen penetration in a blast furnace as a function of blowing oxygen at a supersonic velocity.
Figure 2D:
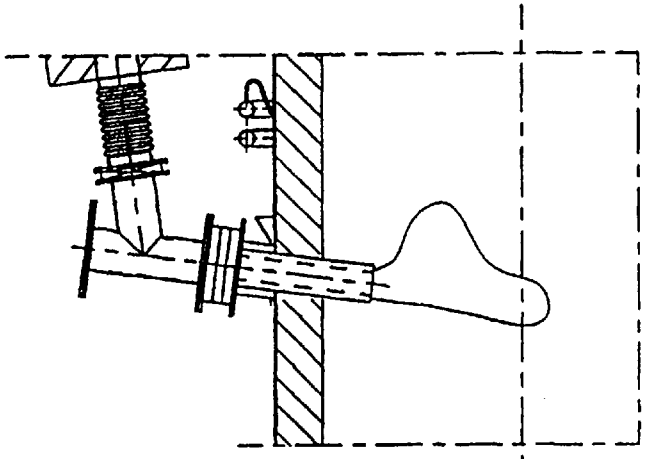
Figure 3:
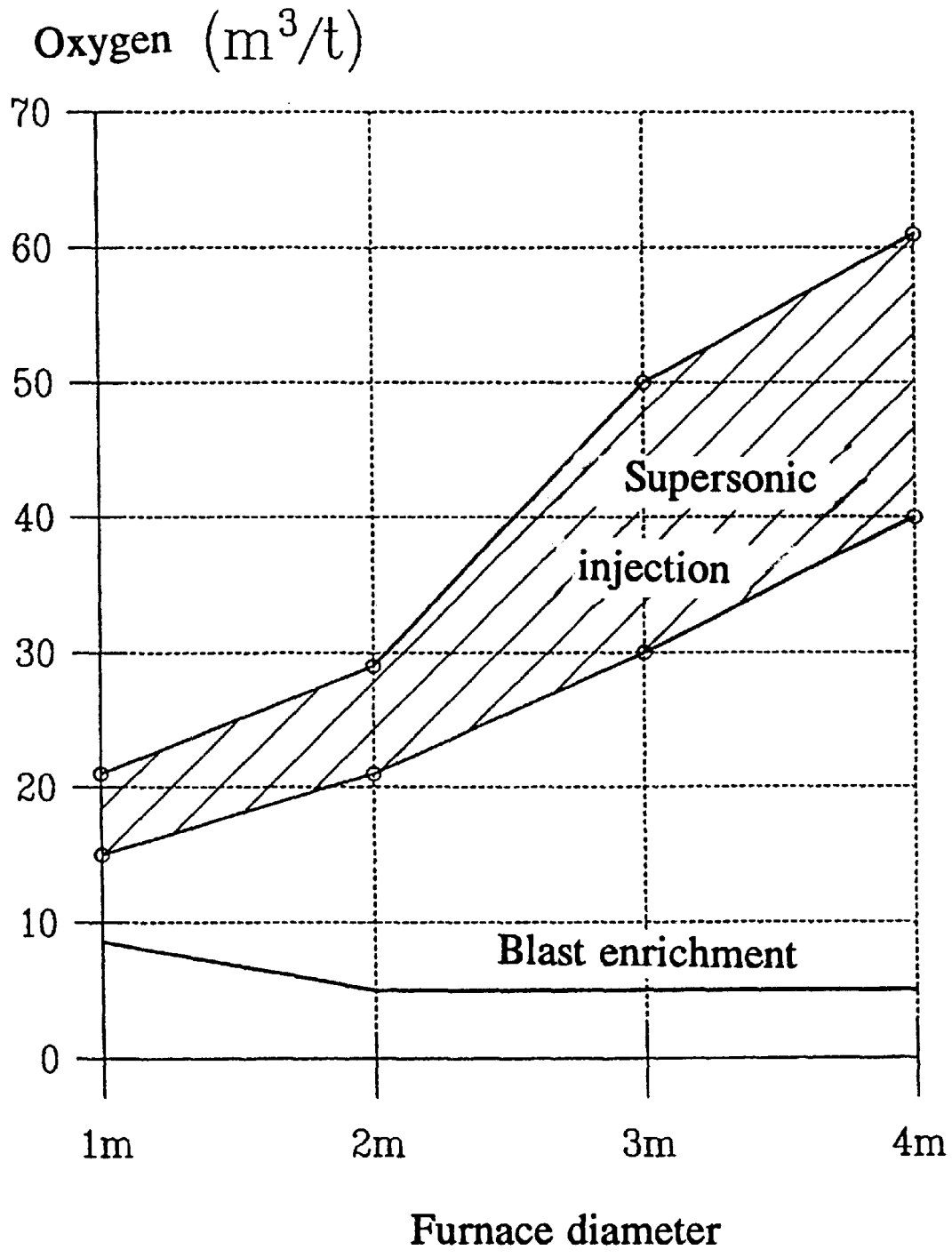
FIG. 3 is a graph showing oxygen volume as a function of furnace diameter.
Figure 4:
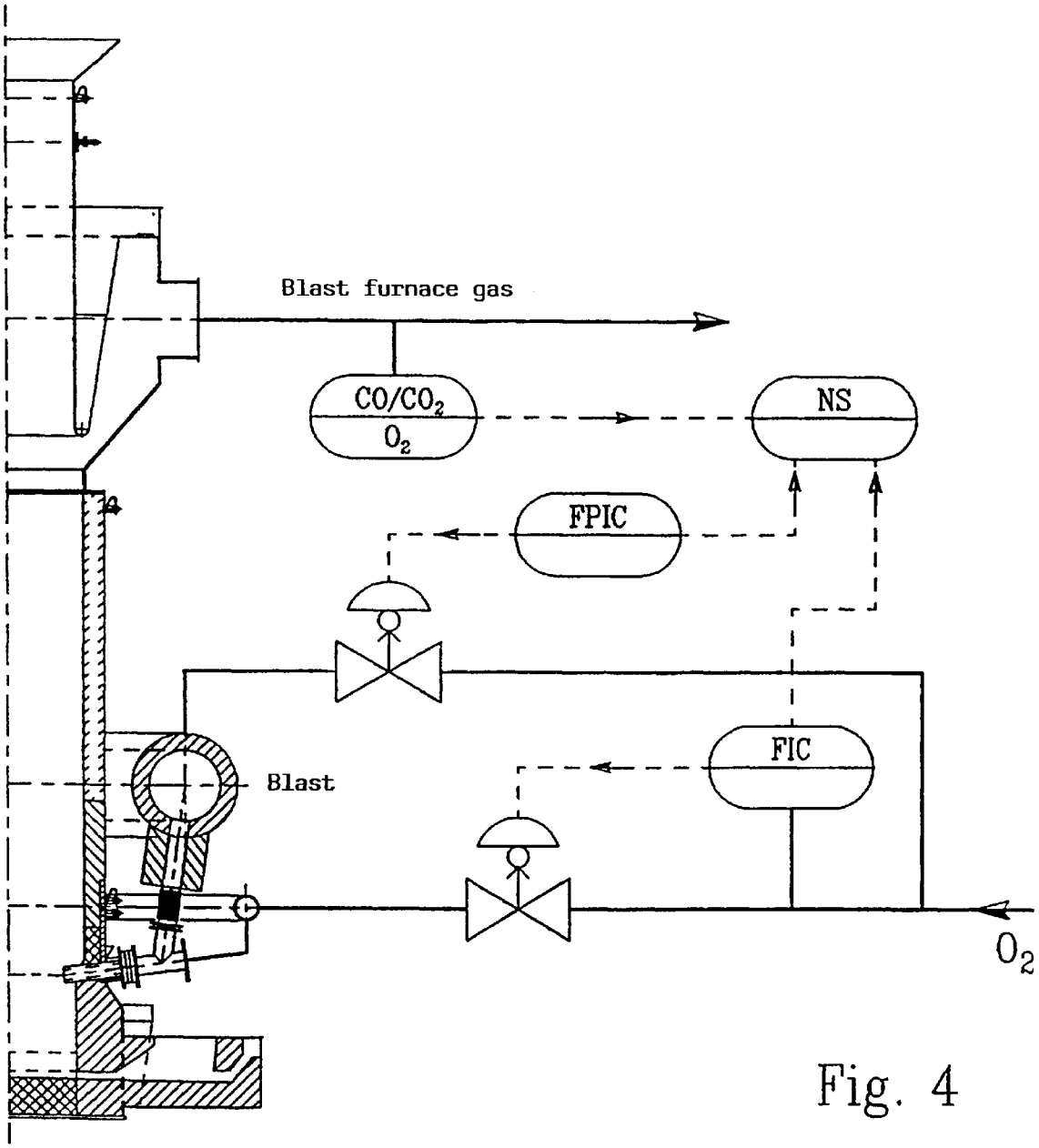
FIG. 4 is a schematic illustration of a shaft furnace with nozzle means for injecting oxygen at supersonic velocity.

By contrast, trials with supersonic nozzles incorporated into the blast nozzles have shown, surprisingly, that the combustion coke can be reduced by 20 to 30 kg/t of Fe, without an adverse effect on the furnace operation and the iron metallurgy, if at the same time the specific furnace blast rate is reduced from 500 to 600 $m^3$ (i.D.)/t of Fe to 400 to 480 $m^3$ (i.N.)/t of Fe and additional oxygen is blown in as a function of the furnace diameter (FIG. 3). The specific oxygen demand must be changed in accordance with FIG. 3. In the case of a hot-blast cupola furnace (500 to 600° C. hot-blast temperature) and a furnace diameter of 1 m, about 15 to 22 $m^3$ (i.N.) of oxygen per ton of iron are required, and 40 to 61 $m^3$ (i.N.) of oxygen per ton of iron are required at a furnace diameter of 4 m. A Mach number of the oxygen jets of $1.1<M<3$ at the nozzle outlet must be set as a function of the furnace diameter. Contrary to the hitherto known cupola furnace theory, the tapping temperature is at the same time increased by up to 30° C. As a result, the silicon burn-off is reduced by 10% and the carburization is improved by 0.2%. The best results with respect to a coke saving are obtained if a fixed part of the oxygen rate is introduced into the cupola furnace by supersonic injection, since a more uniform oxygen distribution across the cross-section of the cupola furnace then applies. The remaining oxygen rate is admixed in a controlled manner with the blast in the blast ring (FIG. 4). This measure makes a constant analytical control possible. The oxygen enrichment in the blast is controlled and regulated via the components CO, $CO_2$ and $O_2$ in the blast furnace gas. The reaction zone, which has advanced in the shape of a tongue to the center of the cupola furnace as a result of the supersonic injection (FIG. 2*c*) is widened upwards and made more uniform, since, due to the suction power of the supersonic jet, combustion air enriched with $O_2$ is additionally transported into the furnace center (FIG. 2*d*).

Owing to the reduction in the furnace blast, the furnace pressure is reduced and the rate of blast furnace gas is diminished by 20%. Due to the lower flow velocity in the furnace, the dust quantity is additionally reduced proportionally to the rate of blast furnace gas. The hot-blast temperature increases by up to 30° C., since the recuperator has less to do due to the reduced blast rate.

The following principles apply to the division of the oxygen addition in each case to the blast ring and to the nozzles:

The basic quantities can be selected from the OCI1.XL5 diagram. The absolute rate of the oxygen addition is determined by the desired iron temperature. The iron temperature increases when the temperature in the coke bed increases. The temperature in the coke bed increases when the cooling effect of the nitrogen accompanying the oxygen is absent.

The amount of oxygen to be added supersonically through the lances increases with the size of the furnace. The optimum ratio between the oxygen rate added through the lances=O1 and the oxygen rate added as enrichment to the blast=O2 is sought on start-up by measuring the iron temperature and is then preset on the controller.

The optimum ratio of the volume fractions of CO and $CO_2$ in the blast furnace gas is determined from the sum of the resulting operating costs. A more powerfully reducing atmosphere with higher CO contents yields savings of silicon and higher costs for coke. The optimum setting therefore also depends on the particular market prices of the raw materials. There are times and countries where a more oxidizing operating procedure is economical. The most advantageous $CO/CO_2$ ratio must therefore be checked from time to time, and the appropriate oxygen rate must be set.

The intended optimum $CO/CO_2$ setting fluctuates, because it is caused by the variation in the charged quantities of carbon/iron. These short-term fluctuations can be compensated by adapting the addition of oxygen. The Boudouard reaction is prompt, because the temperature of the coke bed rises very rapidly when oxygen is added. The feeding of the total rate of oxygen to O1 and to O2 is therefore controlled in such a way that the $CO/CO_2$ ratio is held at the most economical value. With this operating procedure, the smallest variation in the analysis is then also achieved.

We claim:

1. A process for smelting metallic raw materials in a shaft furnace, comprising the steps of:

providing in said shaft furnace beds of metallic raw material and coke;

providing a source of preheated oxygen;

mixing a first portion of said preheated oxygen with a flue gas from said shaft furnace to provide a gas mixture; and injecting concurrently into said shaft furnace (1) said gas mixture at a first rate at subsonic velocity and (2) a second portion of said preheated oxygen at a second rate at supersonic velocity wherein said second portion of said preheated oxygen is injected into said coke bed.

2. A process according to claim 1 wherein said second portion of said preheated oxygen is injected at a substantially constant rate.

3. A process according to claim 2 wherein said gas mixture is injected at a variable rate.

4. A process according to claim 1 including the steps of controlling the ratio of the first portion and second portion of preheated oxygen.

5. A process according to claim 1 wherein said gas mixture is injected below said metallic raw material.

6. A process according to claim 1 including the steps of providing a blast ring for injecting said gas mixture and an injection nozzle for injecting said second portion of said preheated oxygen.

* * * * *